US006978759B2

(12) United States Patent
Iriya et al.

(10) Patent No.: US 6,978,759 B2
(45) Date of Patent: Dec. 27, 2005

(54) START-UP CONTROL OF IN-CYLINDER FUEL INJECTION SPARK IGNITION INTERNAL COMBUSTION ENGINE

(75) Inventors: Yuichi Iriya, Yokohama (JP); Masahiro Fukuzumi, Machida (JP); Hitoshi Ishii, Yokosuka (JP); Tsutomu Kikuchi, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/885,076

(22) Filed: Jul. 7, 2004

(65) Prior Publication Data

US 2005/0005900 A1 Jan. 13, 2005

(30) Foreign Application Priority Data

Jul. 8, 2003 (JP) ..... 2003-193455

(51) Int. Cl.[7] ..... F02B 17/00

(52) U.S. Cl. ..... 123/295; 123/305; 123/685; 123/687; 123/491; 123/179.16

(58) Field of Search ..... 123/295, 305, 123/685, 686, 687, 179.16, 491

(56) References Cited

U.S. PATENT DOCUMENTS 5,598,817 A * 2/1997 Igarashi et al. ..... 123/179.17
5,988,136 A * 11/1999 Piock et al. ..... 123/295
6,202,624 B1 * 3/2001 Stuerz et al. ..... 123/295
6,234,141 B1 * 5/2001 Kerns et al. ..... 123/491
6,659,069 B2 * 12/2003 Shiraishi et al. ..... 123/179.16
6,708,661 B1 * 3/2004 Aubourg et al. ..... 123/179.16
6,880,521 B2 * 4/2005 Maemura ..... 123/305
2002/0062813 A1 * 5/2002 Miyashita et al. ..... 123/295
2004/0226534 A1 * 11/2004 Suzuki et al. ..... 123/305

FOREIGN PATENT DOCUMENTS

JP 2000-145510 A 5/2000

OTHER PUBLICATIONS

U.S. Appl. No. 10/885,014, filed Jul. 7, 2004, Maitani et al.

* cited by examiner

*Primary Examiner*—Erick Solis
(74) *Attorney, Agent, or Firm*—Foley & Lardner LLP

(57) ABSTRACT

An in-cylinder fuel injection internal combustion engine (1) is started up by means of compression stroke fuel injection from the beginning of cranking of the engine (1) to the end of a stratified combustion start-up period TST. If the engine (1) reaches complete combustion during the period, a warm-up operation is begun immediately. If the engine (1) does not reach complete combustion during the period, start-up of the engine (1) is continued using intake stroke fuel injection. By means of this control, stable start-up is assured while suppressing the discharge of unburned fuel during start-up of the engine (1).

11 Claims, 8 Drawing Sheets

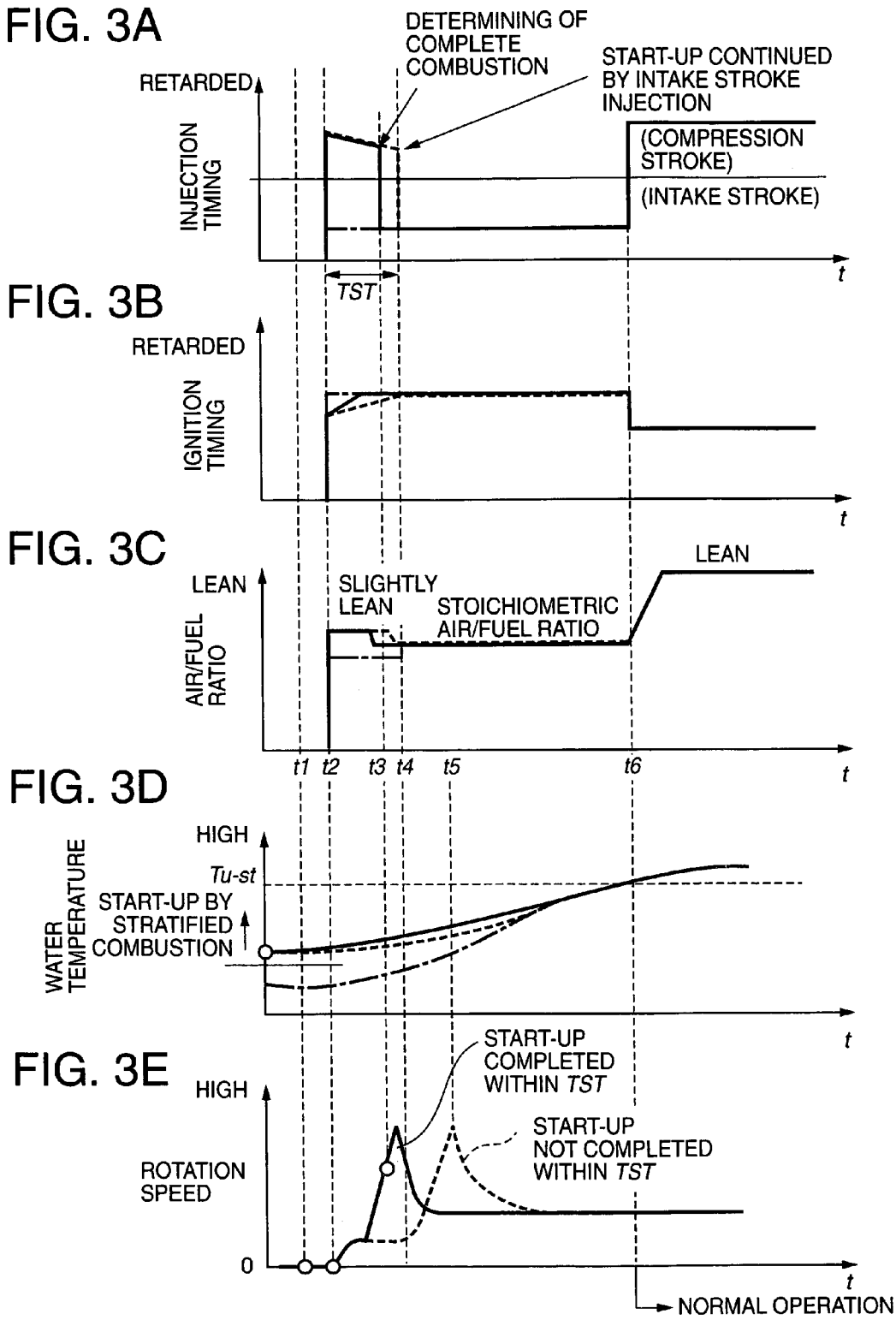
FIG. 3A
DETERMINING OF COMPLETE COMBUSTION
START-UP CONTINUED BY INTAKE STROKE INJECTION
RETARDED
INJECTION TIMING
(COMPRESSION STROKE)
(INTAKE STROKE)
TST
t
FIG. 3B
RETARDED
IGNITION TIMING
t
FIG. 3C
LEAN
SLIGHTLY LEAN
STOICHIOMETRIC AIR/FUEL RATIO
LEAN
AIR/FUEL RATIO
t1 t2 t3 t4 t5 t6
t
FIG. 3D
HIGH
Tu-st
START-UP BY STRATIFIED COMBUSTION
WATER TEMPERATURE
t
FIG. 3E
HIGH
START-UP COMPLETED WITHIN TST
START-UP NOT COMPLETED WITHIN TST
ROTATION SPEED
0
t
NORMAL OPERATION

START-UP CONTROL OF IN-CYLINDER FUEL INJECTION SPARK IGNITION INTERNAL COMBUSTION ENGINE

FIELD OF THE INVENTION

This invention relates to start-up control of a spark ignition internal combustion engine which injects fuel directly into a combustion chamber of a cylinder.

BACKGROUND OF THE INVENTION

When fuel is injected in the intake stroke of an in-cylinder fuel injection spark ignition internal combustion engine during a cold start in the engine such that homogeneous combustion is performed, a three-way catalyst which purifies the exhaust gas is not activated, and hence hydrocarbon (HC) in the exhaust gas generated by combustion of the fuel is discharged without being oxidized.

JP2000-145510A, published by the Japan Patent Office in 2000, proposes that during a cold start of an in-cylinder fuel injection internal combustion engine, the fuel injection amount be determined so as to generate an air-fuel ratio that is slightly leaner than the stoichiometric air-fuel ratio, whereupon fuel is injected in the compression stroke.

When fuel is injected during the compression stroke, the injected fuel is less likely to become adhered to the cylinder wall surface than when fuel is injected during the intake stroke. Moreover, fuel injection during the compression stroke produces stratified combustion in the engine. As a result, less of the air-fuel mixture flows into the quench zone. Furthermore, the exhaust gas temperature rises, which accelerates the oxidation reaction of the HC in the expansion stroke of the engine. Hence the total amount of HC discharge decreases.

SUMMARY OF THE INVENTION

During a cold start of the engine, fuel is less likely to vaporize. Especially when fuel is injected in the compression stroke, the period from injection until combustion is shorter than in the case of the intake stroke injection, that makes the injected fuel further difficult to vaporize. It is therefore difficult to ensure combustion when compression stroke fuel injection is performed during a cold start.

Further, when an attempt is made to start the engine by means of stratified combustion, the start-up characteristic of the engine is greatly influenced by the start-up environment and the battery voltage, and in certain cases, it may be difficult to start the engine.

It is therefore an object of this invention to suppress the discharge of unburned fuel during start-up of an in-cylinder fuel injection internal combustion engine, while ensuring favorable and stable startability regardless of the start-up conditions.

In order to achieve the above object, this invention provides a start-up control device of an internal combustion engine which operates on a four-stroke cycle constituted by an intake stroke, a compression stroke, an expansion stroke, and an exhaust stroke. The engine comprises a combustion chamber, a fuel injector which injects fuel directly into the combustion chamber, and a spark plug which ignites an air-fuel mixture inside the combustion chamber, and performs a start-up operation by cranking by a starter motor and a warm-up operation following the start-up operation.

The control device comprises a sensor which detects an engine rotation speed, and a programmable controller programmed to control the fuel injector.

The controller is programmed to set a stratified combustion start-up period, control the fuel injector to inject fuel in the compression stroke from the beginning of the cranking to the end of the stratified combustion start-up period, determine whether or not the engine rotation speed is greater than a predetermined rotation speed, control the fuel injector to stop injecting fuel in the compression stroke in order to cause the engine to shift from the start-up operation to the warm-up operation when the engine rotation speed exceeds the predetermined rotation speed during the stratified combustion start-up period, and control the fuel injector to stop injecting fuel in the compression stroke at the end of the stratified combustion start-up period and to inject fuel in the intake stroke in order to cause the engine to continue the start-up operation when the engine rotation speed does not exceed the predetermined rotation speed during the stratified combustion start-up period.

This invention also provides a start-up control method of the internal combustion engine above described. The method comprises determining an engine rotation speed, setting a stratified combustion start-up period, controlling the fuel injector to inject fuel in the compression stroke from the beginning of the cranking to the end of the stratified combustion start-up period, determining whether or not the engine rotation speed is greater than a predetermined rotation speed, controlling the fuel injector to stop injecting fuel in the compression stroke in order to cause the engine to shift from the start-up operation to the warm-up operation when the engine rotation speed exceeds the predetermined rotation speed during the stratified combustion start-up period, and controlling the fuel injector to stop injecting fuel in the compression stroke at the end of the stratified combustion start-up period and to inject fuel in the intake stroke in order to cause the engine to continue the start-up operation when the engine rotation speed does not exceed the predetermined rotation speed during the stratified combustion start-up period.

The details as well as other features and advantages of this invention are set forth in the remainder of the specification and are shown in the accompanying drawings.

BRIEF DESCRIPTION OF THE DRAWINGS

FIGS. 3A–3E are timing charts illustrating the execution results of the fuel injection control routine.

DESCRIPTION OF THE PREFERRED EMBODIMENTS

Figure 1:
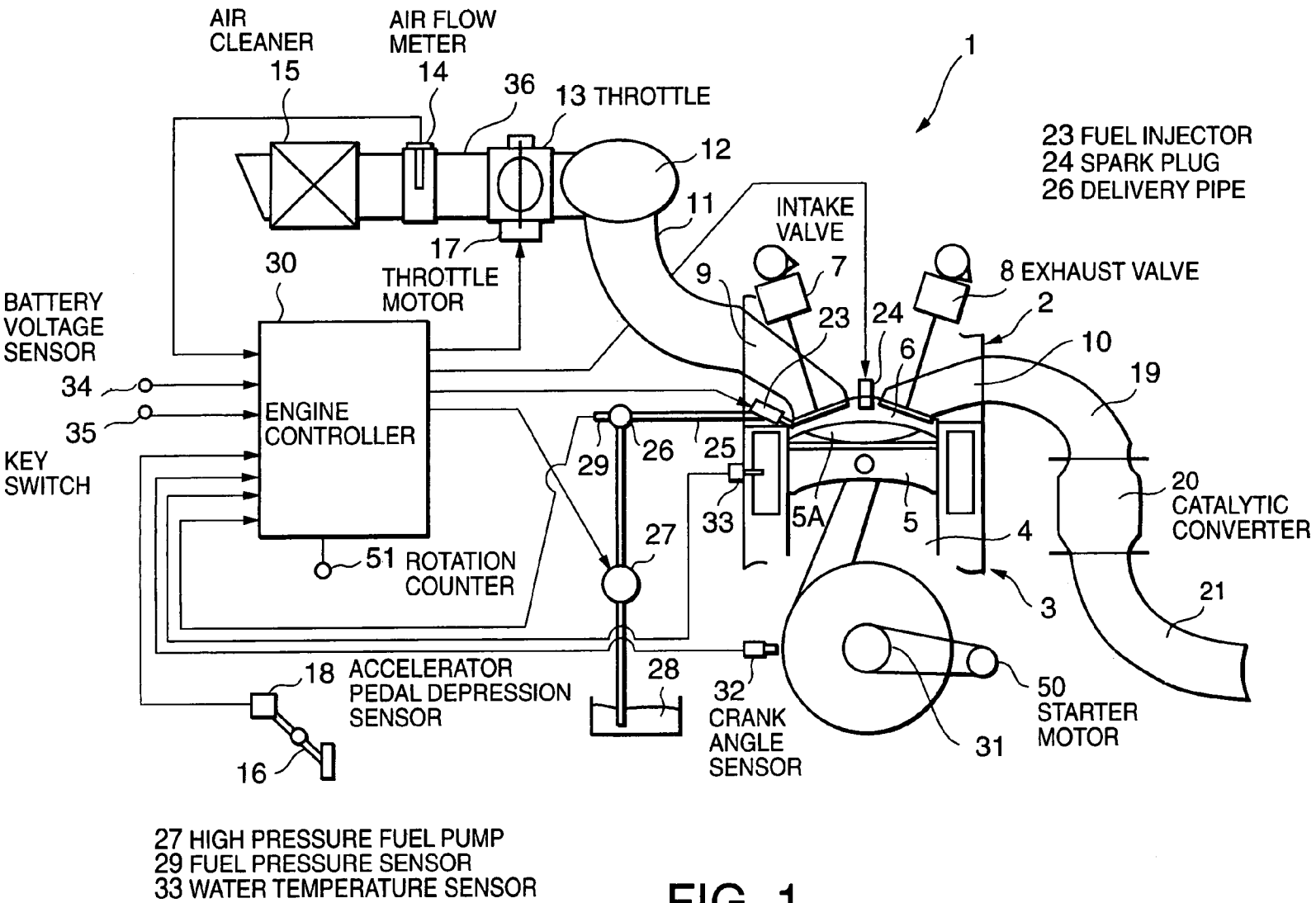
FIG. 1 is a schematic diagram of a start-up control device of an internal combustion engine according to this invention.

Referring to FIG. 1 of the drawings, an in-cylinder fuel injection internal combustion engine 1 for use in a vehicle comprises a cylinder head 2 and a cylinder block 3 in which a plurality of cylinders 4 are formed. A reciprocating piston 5 is housed in each cylinder 4. A combustion chamber 6 is defined by the piston 5, the inner wall of the cylinder 4, and the cylinder head 2. The internal combustion engine 1 is a four-stroke cycle engine in which the piston 5 repeats an intake stroke, a compression stroke, an expansion stroke, and an exhaust stroke in succession within each cylinder 4. The reciprocating motion of the piston 5 is converted into rotary torque by a crankshaft 31.

A piston cavity 5A is formed at the crown of the piston 5 in order to generate tumble of an air-fuel mixture in the combustion chamber 6 during the compression stroke of the piston 5 so that stratified combustion of the air-fuel mixture is performed.

An intake port 9 and an exhaust port 10 are connected to the combustion chamber 6 via an intake valve 7 and an exhaust valve 8 respectively. An intake pipe 36 is connected to the intake port 9 via an intake manifold 11 and a collector 12.

A throttle 13 for regulating the intake air amount of the internal combustion engine 1, and an air cleaner 15, are provided on the intake pipe 36.

The throttle 13 is an electronic throttle driven by a throttle motor 17. The opening of the throttle 13 is varied by an opening signal output to the throttle motor 17 from an engine controller 30.

An accelerator pedal depression sensor 18 which detects a depression amount of an accelerator pedal 16 in the vehicle is provided to control the opening of the throttle 13. The engine controller 30 determines the throttle opening on the basis of the accelerator pedal depression amount, and outputs a corresponding opening signal to the throttle motor 17.

An exhaust pipe 21 is connected to the exhaust port 10 via an exhaust manifold 19. A catalytic converter 20 is interposed in the exhaust pipe 21.

A fuel injector 23 which injects gasoline fuel and a spark plug 24 which ignites the air-fuel mixture are provided respectively in the cylinder head 2 facing into each of the combustion chambers 6.

The fuel injector 23 is connected to a delivery pipe 26 via a fuel supply passage 25. The delivery pipe 26 is supplied with fuel from a fuel tank 28 that has been pressurized by a high pressure fuel pump 27. The delivery pipe 26 functions as an accumulator for storing the high-pressure fuel discharged by the high pressure fuel pump 27 temporarily while maintaining the pressure thereof Cranking to start the internal combustion engine 1 is performed by a starter motor 50 which is activated in response to an operation of a key switch 35.

The fuel injection amount and injection timing of the fuel injector 23 are controlled by the engine controller 30.

To perform this control, signals corresponding to the detected values of an air flow meter 14 which measures the intake air amount in the internal combustion engine 1, a fuel pressure sensor 29 for detecting the fuel pressure in the delivery pipe 26, a crank angle sensor 32 which detects a rotation speed Ne and crank angle of the crankshaft 31, a water temperature sensor 33 which detects a cooling water temperature Tw of the internal combustion engine 1, and a battery voltage sensor 34 which detects a battery voltage Vb of the battery that is installed in the vehicle are input respectively into the engine controller 30. An ON signal and a starter motor operating signal from the key switch 35 are also input. The rotation speed of the crankshaft 31 during cranking of the internal combustion engine 1 corresponds to a cranking speed Nst.

The engine controller 30 is constituted by a microcomputer comprising a central processing unit (CPU), read-only memory (ROM), random access memory (RAM), and an input/output interface (I/O interface). The controller may be constituted by a plurality of microcomputers.

As regards control of the fuel injection timing, the engine controller 30 applies an intake stroke fuel injection mode, in which fuel is injected during the intake stroke, and a compression stroke fuel injection mode, in which fuel is injected during the compression stroke, selectively according to the operating conditions of the engine 1.

Next, the fuel injection control that is executed by the engine controller 30 during cranking of the internal combustion engine 1 will be described.

During cranking of the internal combustion engine 1, the engine controller 30 causes the internal combustion engine 1 to perform stratified combustion by means of compression stroke fuel injection on the basis of one or a plurality of parameters including the cooling water temperature Tw, the cranking speed Nst, the battery voltage Vb, and the fuel pressure Pf.

First, a stratified combustion implementation period TST-m is determined from any of the parameters by referring to a map. The implementation period TST-m is expressed as a time period.

Next, the determined implementation period TST-m is set as the initial value of a stratified combustion timer TST.

The stratified combustion timer TST starts at the same time as the key switch 35 switches ON, and decreases as time elapses. When the stratified combustion timer TST reaches zero, this signifies the end of the stratified combustion implementation period TST-m.

Maps having the characteristics shown in FIGS. 4–7, defining the relationship of the stratified combustion implementation period TST-m to the cooling water temperature Tw, cranking speed Nst, battery voltage Vb, and fuel pressure Pf respectively, are stored in advance in the ROM of the engine controller 30.

By varying the stratified combustion implementation period TST-m in accordance with the conditions during start-up in this manner, the engine controller 30 suppresses the discharge of unburned fuel, or in other words hydrocarbon (HC), directly after the beginning of cranking.

However, if the rotation speed of the internal combustion engine 1 does not reach a complete combustion determining speed Ne-st during the stratified combustion implementation period TST-m, stratified combustion is no longer performed, and instead, start-up is continued by means of homogeneous combustion. This is the purpose of setting the stratified combustion implementation period TST-m. The complete combustion determining speed Ne-st is set within 300–800 revolutions per minute (rpm).

Figure 4:
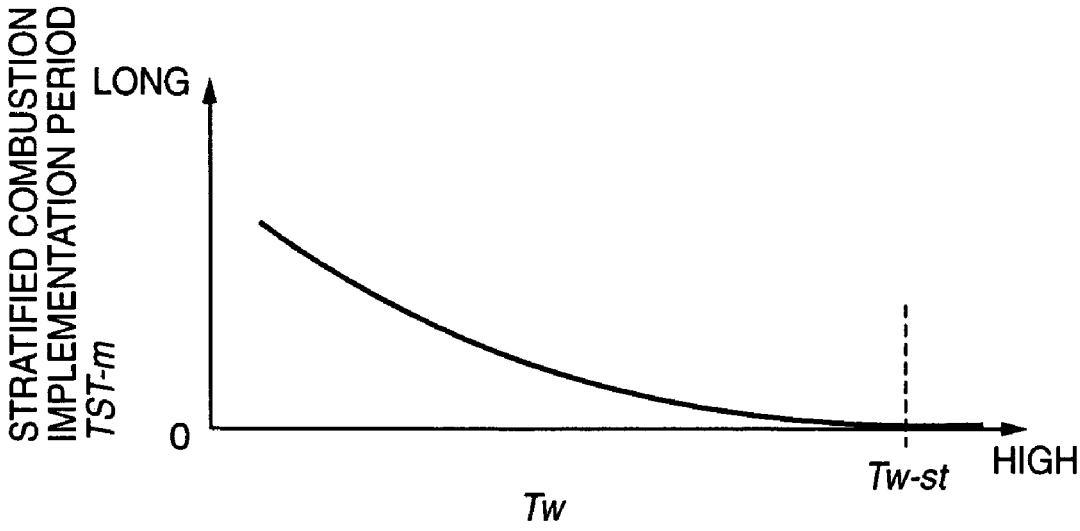
FIG. 4 is a diagram illustrating the characteristic of a map defining the relationship between a stratified combustion implementation period TST-m and an engine cooling water temperature Tw, which is stored by the engine controller.

For example, when the cooling water temperature Tw is low at between zero and ten degrees centigrade, it is difficult to generate stratified combustion, and it takes time to confirm that start-up has been realized through stratified combustion. On the other hand, when the cooling water temperature Tw is higher, stratified combustion is generated easily, and hence the realization of start-up by means of the stratified combustion can be confirmed in a short period of time. Hence the map in FIG. 4 showing the stratified combustion implementation period TST-m based on the cooling water temperature Tw is set such that the stratified combustion implementation period TST-m becomes shorter as the cooling water temperature Tw rises. Moreover, when the cooling water temperature Tw reaches a warm-up complete temperature Tw-st, the need for compression stroke fuel injection to enable stratified combustion disappears completely. Accordingly, in this case TST-m becomes zero. The warm-up completion temperature Tw-st is set at eighty degrees centigrade.

By setting the map in this manner, the time required for start-up can be shortened further than a case in which compression stroke fuel injection is always performed for a fixed time period during start-up of the internal combustion engine 1.

Figure 5:
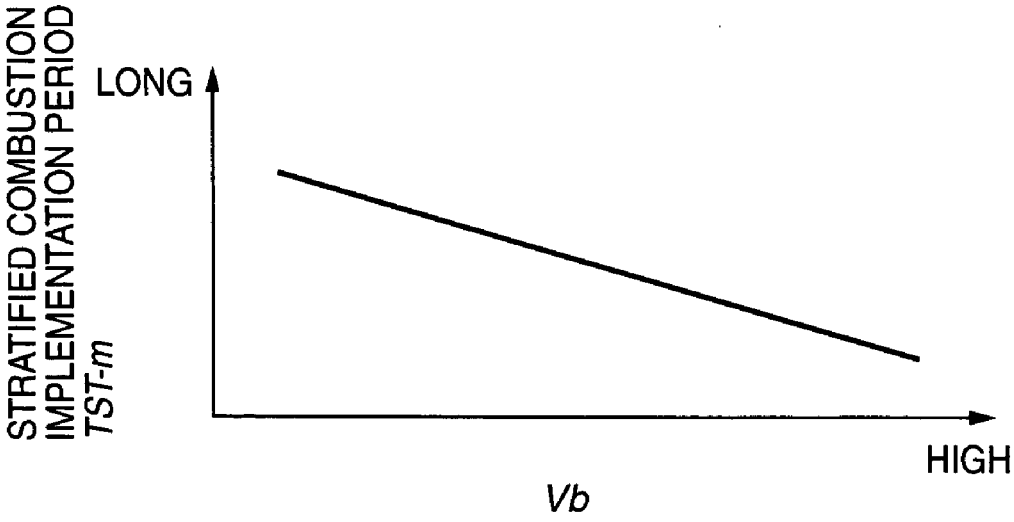
FIG. 5 is a diagram illustrating the characteristic of a map defining the relationship between the stratified combustion implementation period TST-m and a battery voltage Vb, which is stored by the engine controller.
Figure 6:
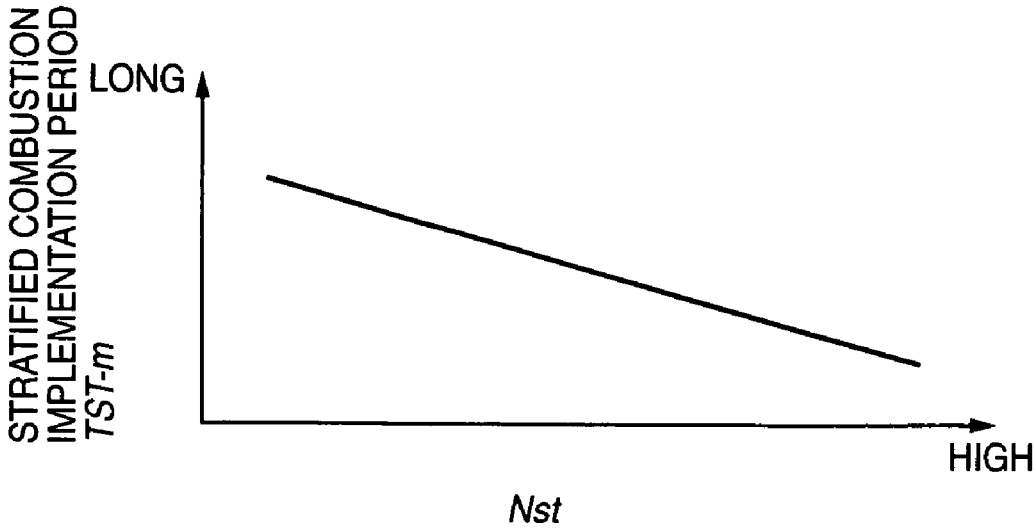
FIG. 6 is a diagram illustrating the characteristic of a map defining the relationship between the stratified combustion implementation period TST-m and a cranking speed Nst, which is stored by the engine controller.
Figure 7:
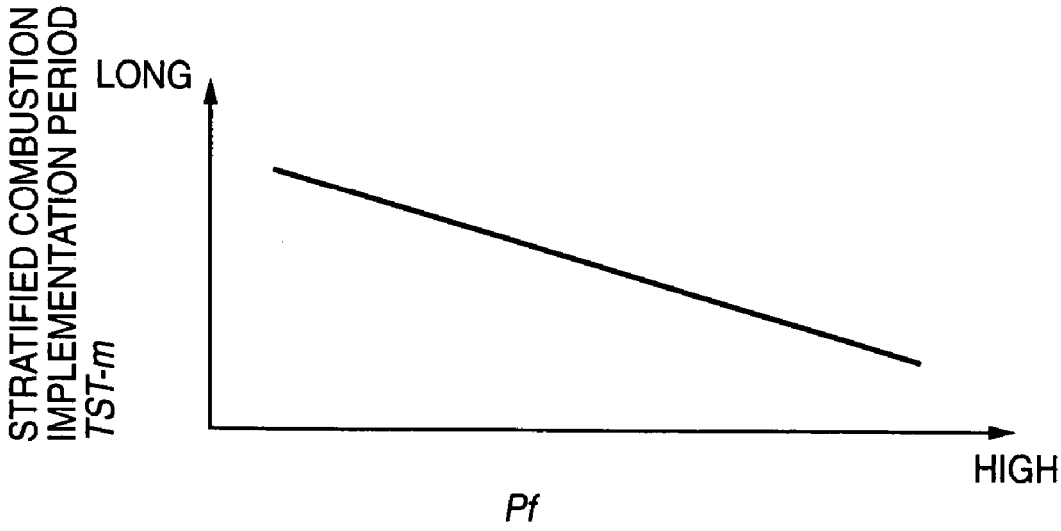
FIG. 7 is a diagram illustrating the characteristic of a map defining the relationship between the stratified combustion implementation period TST-m and a fuel pressure Pf, which is stored by the engine controller.

Likewise, the characteristic of the map in FIG. 5 showing the stratified combustion implementation period TST-m based on the battery voltage Vb, the characteristic of the map in FIG. 6 showing the stratified combustion implementation period TST-m based on the cranking speed Nst, and the characteristic of the map in FIG. 7 showing the stratified combustion implementation period TST-m based on the fuel pressure Pf are set such that the stratified combustion implementation period TST-m becomes shorter as the environment becomes more conducive to realizing stratified combustion.

More specifically, when the battery voltage Vb is high, ignition is performed favorably, and hence stratified combustion can be realized easily. Start-up of the internal combustion engine 1 through stratified combustion becomes easier as the cranking speed Nst increases. A stratified air-fuel mixture becomes easier to form as the fuel pressure Pf increases. Each of these elements facilitates the realization of stratified combustion.

In FIG. 4, the cooling water temperature Tw is used as the parameter representing the temperature of the internal combustion engine 1. Accordingly, it is possible to detect the oil temperature of the engine oil instead of the cooling water temperature Tw, and to set the stratified combustion implementation period TST-m in accordance with the oil temperature.

During stratified combustion occurring as a result of compression stroke fuel injection, a mass of air-fuel mixture having an air-fuel ratio at which stable ignition can be obtained is formed around the spark plug 24. On the outside of this mass, the fuel concentration decreases such that the average air-fuel ratio of the entire combustion chamber 6 is slightly leaner than the stoichiometric air-fuel ratio.

When the fuel pressure Pf is lower than a pressure Pf-st for permitting fuel injection during start-up, or the cranking speed Nst is lower than a speed Nst-st for permitting fuel injection during start-up, or the battery voltage Vb is lower than a voltage Vb-st for permitting fuel injection during start-up, the engine controller 30 prohibits fuel injection by the fuel injector 23.

During cranking of the internal combustion engine 1, the engine controller 30 controls the fuel injector 23 to perform fuel injection in the compression stroke during the stratified combustion implementation period TST-m set as described above, and controls the fuel injector 23 to perform fuel injection in the intake stroke once the stratified combustion implementation period TST-m has ended.

During fuel injection in the intake stroke, the time period from injection to ignition is long, and hence mixing of the fuel and air is promoted, leading to stable ignition. Thus by switching to intake stroke fuel injection following the end of the stratified combustion implementation period TST-m, start-up of the internal combustion engine 1 can be ensured.

Further, when the rotation speed of the internal combustion engine 1 exceeds the complete combustion determining speed Ne-st during the stratified combustion implementation period TST-m, the engine controller 30 determines that start-up of the internal combustion engine 1 is complete, and hence switches the fuel injection timing from compression stroke fuel injection to intake stroke fuel injection immediately, without waiting for the end of the stratified combustion implementation period TST-m.

When start-up of the internal combustion engine 1 is complete, the engine controller 30 operates the internal combustion engine 1 by means of intake stroke fuel injection in order to perform a warm-up operation. At this time, the air-fuel ratio of the air-fuel mixture that is burned in the internal combustion engine 1 is set to the vicinity of the stoichiometric air-fuel ratio. At this air-fuel ratio, the internal combustion engine 1 realizes a favorable exhaust environment in which an idling rotation speed is maintained and the amount of nitrogen oxide (NOx) discharge is suppressed.

Also, when the cooling water temperature Tw reaches a warm-up completion temperature Tw-st during the stratified combustion implementation period TST-m, the engine controller 30 switches immediately from compression stroke fuel injection to intake stroke fuel injection.

Next, referring to FIG. 2, a routine executed by the engine controller 30 to realize the control described above will be described. Execution of this routine begins at the same time as the key switch 35 is switched ON, and the routine is executed repeatedly thereafter at intervals of ten milliseconds until a warm-up operation or normal operation begins.

First, in a step S1, the engine controller 30 determines whether or not the key switch 35 has just turned ON from OFF. The result of this determination is substantially only positive during the first execution of the routine.

When the determination is positive, the engine controller 30 refers to the map corresponding to FIG. 4 which is stored in the internal ROM in advance, in a step S2 to read the stratified combustion implementation period TST-m on the basis of the cooling water temperature Tw. As noted above, in this map the stratified combustion implementation period TST-m lengthens as the temperature decreases. At or below the minimum temperature set in the map, intake stroke fuel injection is performed instead of compression stroke fuel injection. The stratified combustion implementation period TST-m in this case is set to zero. Here, the minimum temperature is set at zero degrees centigrade, but may be set at a higher temperature, for example from five to ten degrees centigrade.

TST-m may also be read from corresponding maps based on any of the cranking speed Nst, the battery voltage Vb, and the fuel pressure Pf, instead of cooling water temperature Tw.

Next, in a step S3, the engine controller 30 sets the map value TST-m read from the map as the initial value of the stratified combustion timer TST.

Following the processing of the step S3, the engine controller 30 performs the processing of a step S4. When the determination in the step S1 is negative, the engine controller 30 skips the steps S2 and S3, and performs the processing of the step S4. From the second execution of the routine onward, the determination in the step S1 is always negative.

In the step S4, the engine controller 30 compares the fuel pressure Pf with the aforementioned fuel injection permitting pressure Pf-st, the cranking speed Nst with the aforementioned fuel injection permitting speed Nst-st, and the battery voltage Vb with the aforementioned fuel injection permitting voltage Vb-st.

If, as a result, at least one of the fuel pressure Pf, the cranking speed Nst, and the battery voltage Vb falls below the value for permitting fuel injection, the engine controller 30 prohibits fuel injection by the fuel injector 23 in a step S5. Following the processing of the step S5, the engine controller 30 ends the routine.

When none of the fuel pressure Pf, cranking speed Nst, and battery voltage Vb fall below the value for permitting fuel injection, the engine controller 30 compares the cooling water temperature Tw to the warm-up completion temperature Tw-st in a step S6. If the cooling water temperature Tw has reached the warm-up completion temperature Tw-st, the engine controller 30 moves to the normal operation in a step S12.

In the normal operation, the fuel injection timing is switched in accordance with the operating conditions. It is assumed that fuel injection control during the normal operation is performed in a separate routine. After moving to the normal operation, execution of this routine is halted. Following the processing of the step S12, the engine controller 30 ends the routine.

If, in the step S6, the cooling water temperature Tw has not reached the warm-up completion temperature Tw-st, the engine controller 30 determines whether or not the stratified combustion timer TST is at zero in a step S7.

If the stratified combustion timer TST is at zero, the engine controller 30 switches the fuel injection timing from compression stroke fuel injection to intake stroke fuel injection, and executes intake stroke fuel injection for start-up at the stoichiometric air-fuel ratio in a step S11.

Next, in a step S14, the engine controller 30 compares the engine rotation speed Ne with the complete combustion determining speed Ne-st. If the engine rotation speed Ne does not exceed the complete combustion determining speed Ne-st, the engine controller 30 ends the routine without performing any further processing.

If the engine rotation speed Ne does exceed the complete combustion determining speed Ne-st, the engine controller 30 moves to a warm-up operation in a step S10. It is assumed that fuel injection control during the warm-up operation is performed in a separate routine. After moving to the warm-up operation, execution of this routine is halted. Following the processing of the step S10, the engine controller 30 ends the routine.

If, on the other hand, the stratified combustion timer TST is greater than zero in the step S7, the engine controller 30 selects compression stroke fuel injection for start-up in a step S8. Here, the routine execution interval and the fuel injection execution interval differ. The compression stroke fuel injection selected in the step S8 is executed at the next fuel injection opportunity. The fuel injection amount is set to a predetermined amount corresponding to a slightly lean air-fuel ratio.

Next, in a step S9, the engine controller 30 compares the engine rotation speed Ne to the complete combustion determining speed Ne-st. If the engine rotation speed Ne does not exceed the complete combustion determining speed Ne-st, the engine controller 30 decrements the stratified combustion timer TST in a step S13. Following the processing of the step S13, the engine controller 30 ends the routine. If, on the other hand, the engine rotation speed Ne does exceed the complete combustion determining speed Ne-st, the engine controller 30 moves to the warm-up operation in the aforementioned step S10, and then ends the routine.

Referring to FIGS. 3A–3E, when the key switch 35 switches ON at a time t1, first the stratified combustion timer TST is set to its initial value according to the first execution of the routine described above. At this stage, the starter motor 50 is inoperative, and hence the cranking speed Nst is zero, producing a positive determination in the step S4. Accordingly, fuel injection is prohibited in the step S5, and hence fuel injection is not performed.

At a time t2, after the starter motor operating signal is output and cranking begins, the determination in the step S4 becomes negative, and processing from the step S6 onward in the aforementioned routine is executed.

As a result, as shown by the solid lines in FIGS. 3A–3C, fuel injection from the fuel injector 23 and ignition by the spark plug 24 commence. When the cooling water temperature Tw is lower than the warm-up completion temperature Tw-st during the stratified combustion implementation period TST-m, the fuel injection timing is set to compression stroke fuel injection by the processing of the step S8, as shown by the solid line in FIG. 3A. Further, in order to implement stratified combustion, the air-fuel ratio is set to be slightly leaner than the stoichiometric air-fuel ratio, as shown by the solid line in FIG. 3C.

At a time t3, when the engine rotation speed Ne reaches the complete combustion determining speed Ne-st as shown by the solid line in FIG. 3E, the internal combustion engine 1 moves to a warm-up operation by means of the processing of the steps S9 and S10. Hence, from the time t3 onward, the fuel injection timing switches to intake stroke fuel injection, as shown by the solid line in FIG. 3A, and the stoichiometric air-fuel ratio is applied as the air-fuel ratio, as shown in FIG. 3C.

Conversely, as shown by the broken lines in FIGS. 3A–3E, when the engine rotation speed Ne does not reach the complete combustion determining speed Ne-st during the stratified combustion implementation period TST-m, the engine controller 30 repeats the processing of the steps S1, S4, S6–S9, and S13 until the stratified combustion implementation period TST-m terminates.

Then, at a time t4 when the value of the stratified combustion timer TST reaches zero in the step S7, the engine controller 30 switches the fuel injection timing to the intake stroke in the step S11, whereupon start-up is continued by means of homogeneous combustion at the stoichiometric air-fuel ratio.

As a result of the homogeneous combustion produced by intake stroke fuel injection, the time required for vaporizing the fuel that is injected into the combustion chamber 6 is secured. Hence even when start-up is not successful by means of stratified combustion, ignition and combustion of the air-fuel mixture can be performed with stability by means of homogeneous combustion.

As a result, as shown by the broken line in FIG. 3E, the engine rotation speed Ne reaches the complete combustion determining speed Ne-st at a time t5. When the engine rotation speed Ne reaches the complete combustion determining speed Ne-st, the determination in the step S14 becomes positive, and thus the engine controller 30 moves to the warm-up operation in the step S10.

The dotted lines shown in FIGS. 3A–3F show the start-up condition when the cooling water temperature Tw is below the setting range for the stratified combustion implementation period TST-m of the map in FIG. 4, or in other words when the cooling water temperature Tw is extremely low, as shown in FIG. 3D.

In this case, the initial value of the stratified combustion timer TST is set to zero in the step S2, and hence the result of the step S7 is negative from the first execution of the routine. Accordingly, intake stroke fuel injection and homogeneous combustion are performed in the step S11. As a result, the fuel injection timing continues to be set to the intake stroke until the completion of warm-up, as shown by the dotted line in FIG. 3A.

Figure 2:
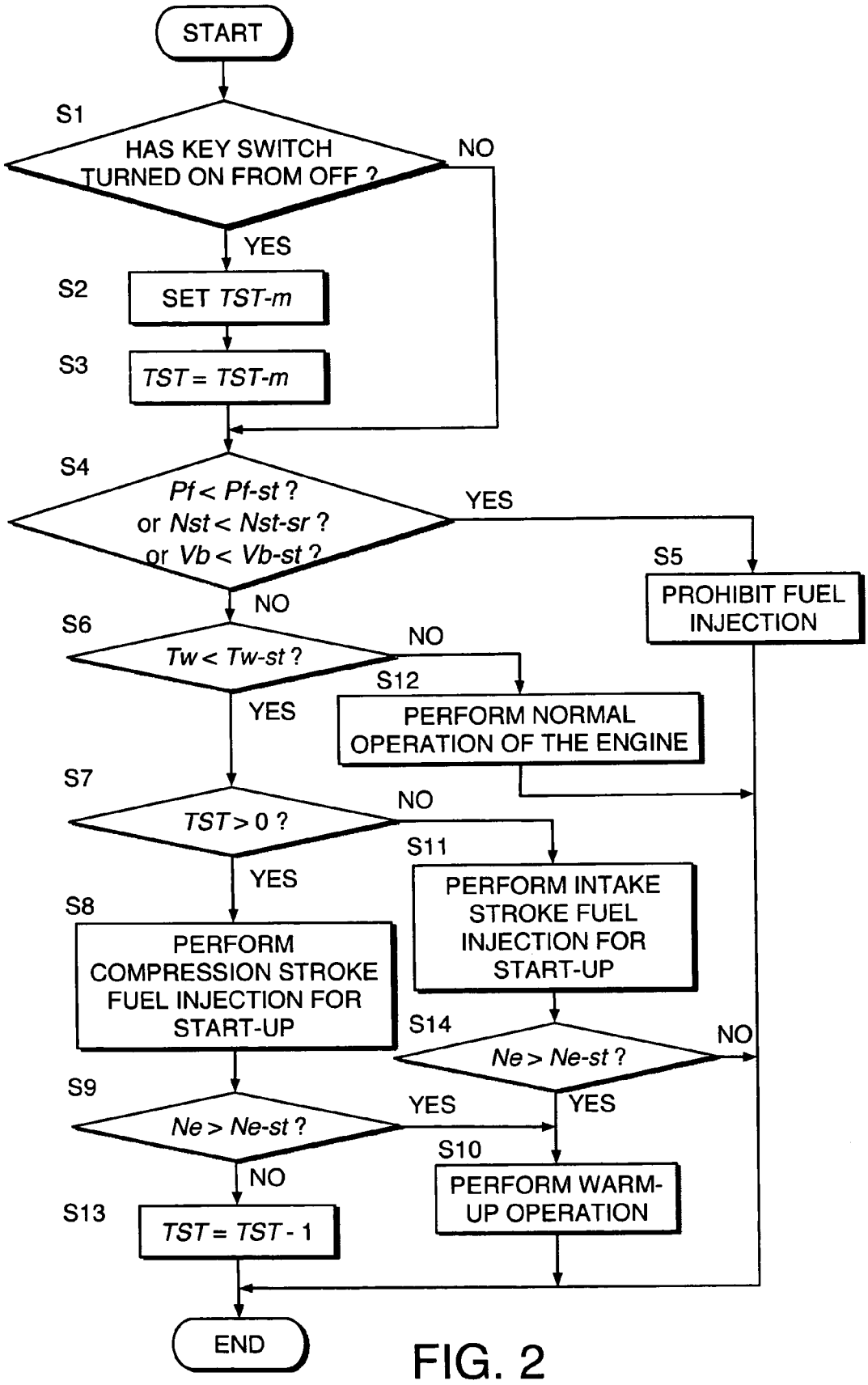
FIG. 2 is a flowchart illustrating a fuel injection control routine executed during engine start-up by an engine controller according to this invention.

Although not illustrated in the routine in FIG. 2, it is preferable that during intake stroke fuel injection for start-up, a rich air-fuel ratio such as that shown by the dotted line in FIG. 3C be applied, as shown in FIG. 3C.

Regardless of whether start-up by stratified combustion is successful or start-up is performed by homogeneous combustion due to the failure of start-up by stratified combustion, the following warm-up operation is performed by means of intake stroke fuel injection, as shown in FIG. 3A. The air-fuel ratio at this time is set to the stoichiometric air-fuel ratio, as shown in FIG. 3C.

At a time t6, when the cooling water temperature Tw reaches the warm-up completion temperature Tw-st as a result of the warm-up operation, as shown in FIG. 3D, the internal combustion engine 1 moves to a normal operation. In the normal operation, fuel injection is performed in accordance with the operating conditions.

The timing chart shows a case in which the internal combustion engine 1 operates at a lean air-fuel ratio from the time t6 onward by means of compression stroke fuel injection. The lean air-fuel ratio in this case is even leaner than the lean air-fuel ratio applied during the stratified combustion implementation period TST-m.

According to this invention as described above, by starting an in-cylinder fuel injection internal combustion engine by means of stratified combustion, the discharge of unburned fuel can be suppressed. When start-up by means of stratified combustion is difficult, the internal combustion engine immediately switches to homogeneous combustion to continue start-up, and hence favorable startability can be ensured.

Next, referring to FIGS. 8–12, a second embodiment of this invention will be described.

In this embodiment, the fuel injection control algorithms during start-up of the internal combustion engine 1 differ from those of the first embodiment. The constitution of the hardware of the start-up control device according to this embodiment corresponds to that of the first embodiment with the addition of a rotation counter 51 which counts an accumulated number of rotations Tcycle-st from the beginning of cranking of the internal combustion engine 1. The accumulated number of rotations Tcycle-st detected by the rotation counter 51 is input into the engine controller 30 as a signal.

The engine controller 30 according to this embodiment defines the stratified combustion implementation period by the accumulated number of rotations from the beginning of cranking of the internal combustion engine 1, which is detected by the rotation counter 51, instead of by the time period TST-m.

In the first embodiment, the number of compression stroke fuel injections performed during the stratified combustion implementation period differs according to differences in the cranking speed Nst, but by defining the stratified combustion implementation period by the accumulated number of rotations of the internal combustion engine 1, the influence of the cranking speed Nst on the number of times compression stroke fuel injection is executed can be eliminated.

Figure 8:
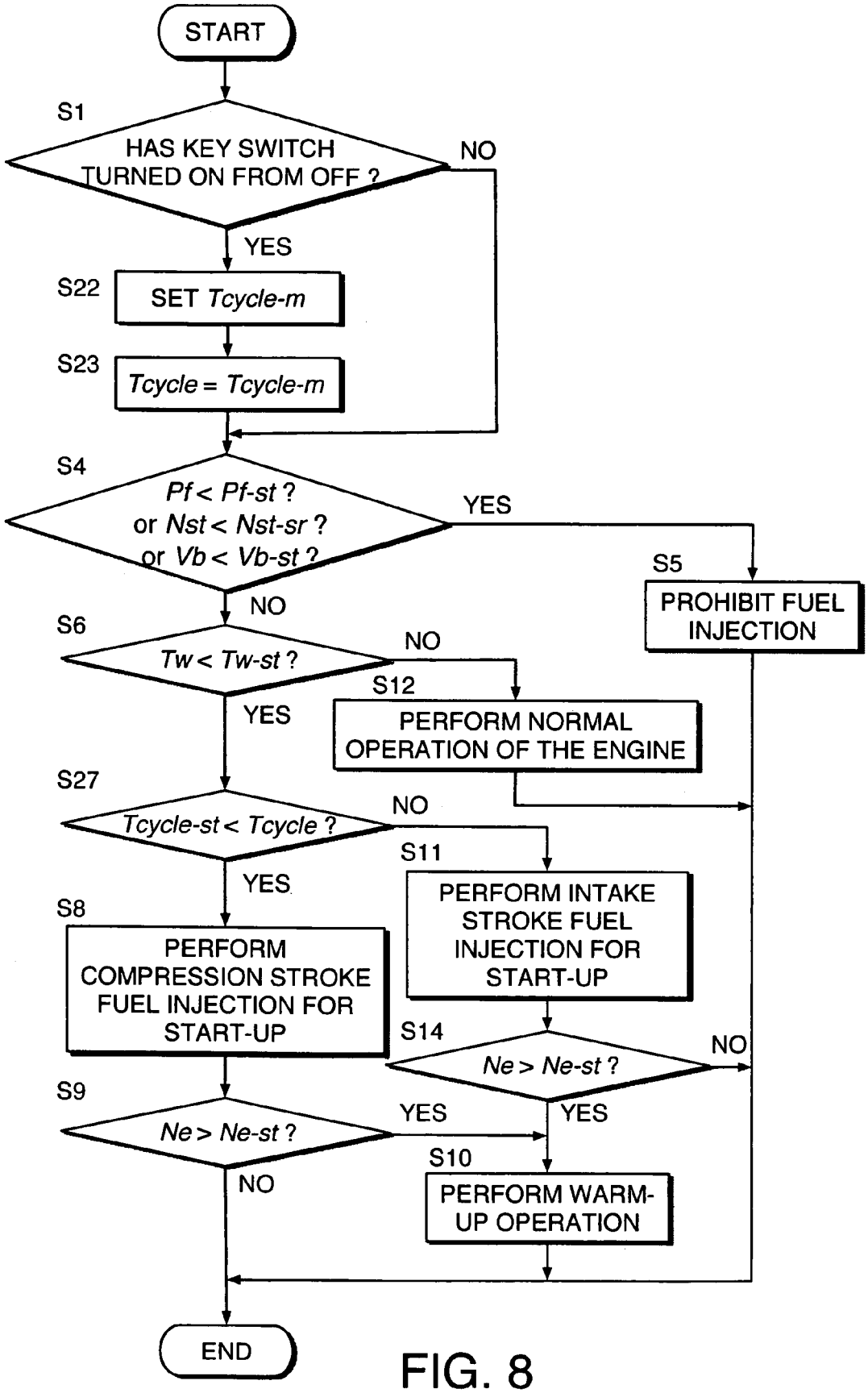
FIG. 8 is similar to FIG. 2, but shows a second embodiment of this invention.

To realize this control, the engine controller 30 executes the routine shown in FIG. 8 in place of the routine of FIG. 2.

In the routine in FIG. 8, the steps S2, S3, and S7 in the routine in FIG. 2 are replaced by steps S22, S23, and S27 respectively, and the step S13 in the routine in FIG. 2 is omitted.

In the step S22, the engine controller 30 refers to the aforementioned map that is stored in the internal ROM in advance to read a stratified combustion completion cycle Tcycle-m of the internal combustion engine 1 based on the cooling water temperature Tw. The stratified combustion completion cycle Tcycle-m is expressed by the accumulated number of rotations from the beginning of cranking of the internal combustion engine 1.

Figure 9:
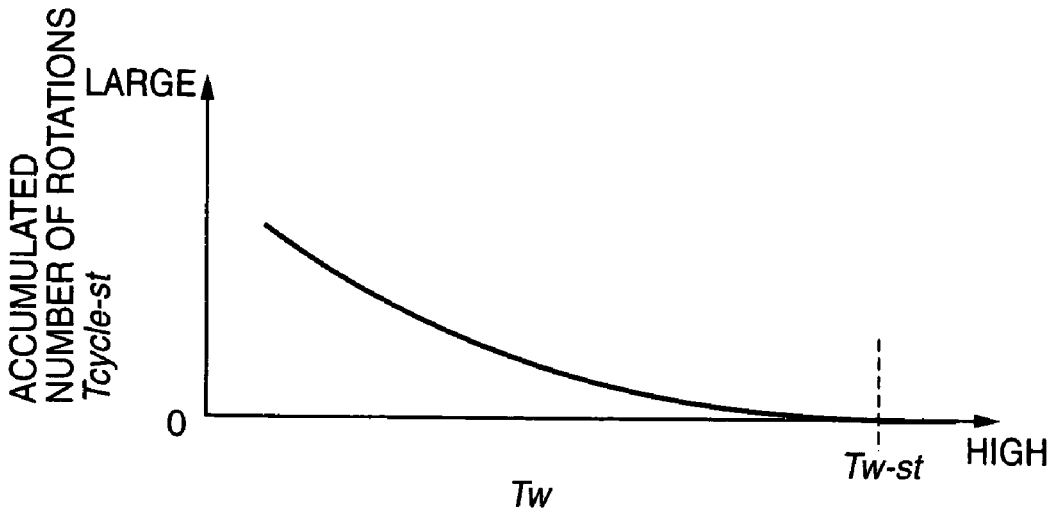
FIG. 9 is a diagram illustrating the characteristic of a map defining the relationship between a number of stratified combustion executions Tcycle-m and the engine cooling water temperature Tw, which is stored by an engine controller according to the second embodiment of this invention.

Referring to FIG. 9, the value of the stratified combustion completion cycle Tcycle-m is set to increase as the cooling water temperature Tw decreases. Further, similarly to the stratified combustion implementation period TST-m, the stratified combustion completion cycle Tcycle-m is set to zero at or below a minimum temperature set in the map.

Figure 10:
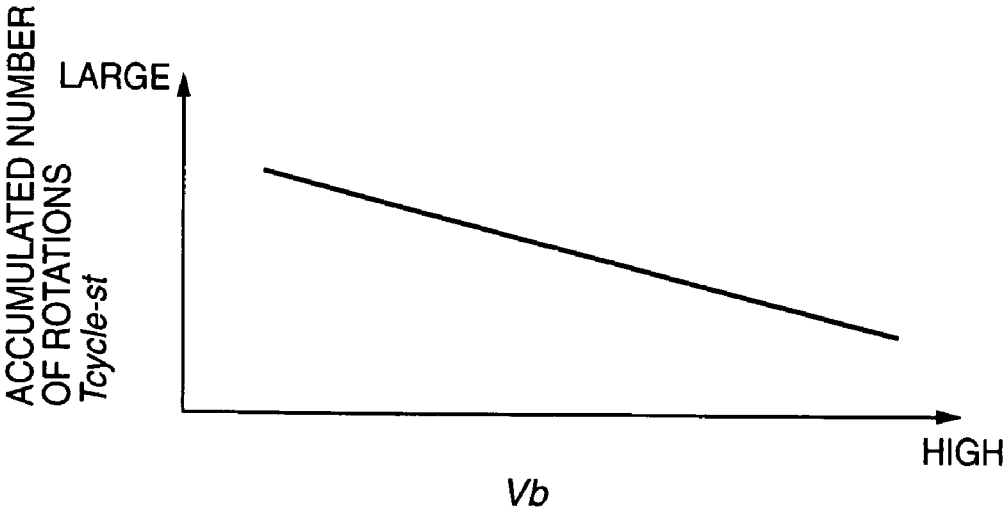
FIG. 10 is a diagram illustrating the characteristic of a map defining the relationship between the number of stratified combustion executions Tcycle-m and the battery voltage Vb, which is stored by the engine controller according to the second embodiment of this invention.
Figure 11:
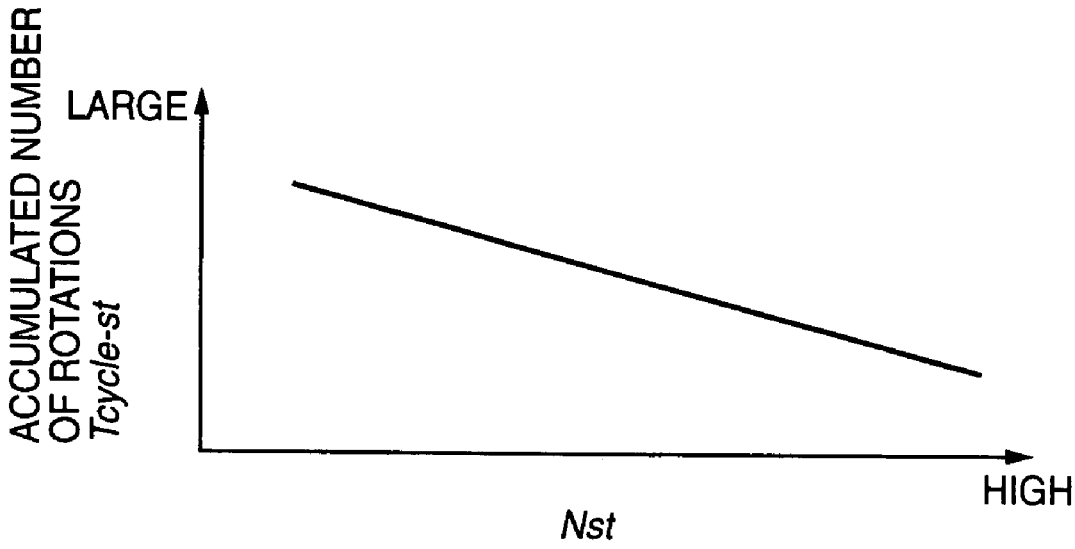
FIG. 11 is a diagram illustrating the characteristic of a map defining the relationship between the number of stratified combustion executions Tcycle-m and the cranking speed Nst, which is stored by the engine controller according to the second embodiment of this invention.
Figure 12:
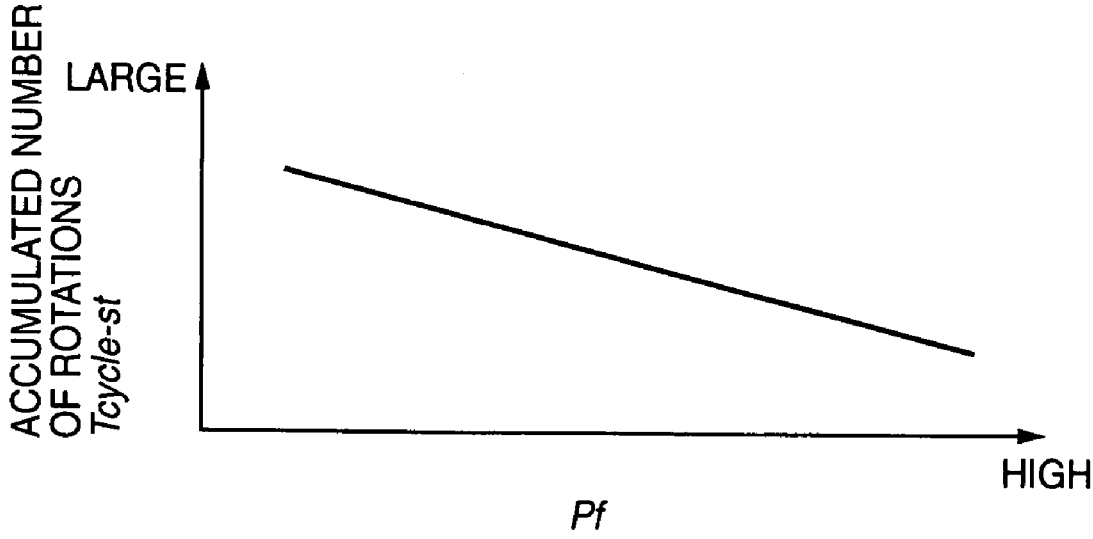
FIG. 12 is a diagram illustrating the characteristic of a map defining the relationship between the number of stratified combustion executions Tcycle-m and the fuel pressure Pf, which is stored by the engine controller according to the second embodiment of this invention.

As shown in FIGS. 10–12, the battery voltage Vb, cranking speed Nst, and fuel pressure Pf may also be used as parameters for determining the stratified combustion completion cycle Tcycle-m.

In the step S23, the engine controller 30 sets the stratified combustion completion cycle Tcycle-m read from the map as a stratified combustion completion determining value Tcycle.

In the step S27, the engine controller 30 determines whether or not the accumulated number of rotations Tcycle-st has reached the stratified combustion completion determining value Tcycle.

By executing the routine described above, compression stroke fuel injection for producing stratified combustion upon start-up of the internal combustion engine 1 is performed in the step S8 unless the stratified combustion completion determining value Tcycle is set to zero.

If the cooling water temperature Tw reaches the warm-up completion temperature Tw-st in the step S6 before the accumulated number of rotations Tcycle-st reaches the stratified combustion completion determining value Tcycle, the engine controller 30 moves to a normal operation in the step S12, similarly to the first embodiment.

Further, if the engine rotation speed Ne reaches the complete combustion determining speed Ne-st before the accumulated number of rotations Tcycle-st reaches the stratified combustion completion determining value Tcycle, the engine controller 30 moves to the warm-up operation in the step S10.

In other words, when the internal combustion engine 1 reaches complete combustion, the engine controller 30 ends stratified combustion start-up immediately an moves to a warm-up operation even if the accumulated number of rotations Tcycle-st has not reached the stratified combustion completion determining value Tcycle,.

Furthermore, even when the accumulated number of rotations Tcycle-st reaches the stratified combustion completion determining value Tcycle, if the engine rotation speed Ne has not reached the complete combustion determining speed Ne-st, start-up is continued by means of intake stroke fuel injection in the step S11 until the engine rotation speed Ne reaches the complete combustion determining speed Ne-st.

According to this embodiment, in addition to achieving similar effects to those of the first embodiment, compression stroke fuel injection is performed a set number of times without being influenced by the cranking speed Nst, and hence start-up control can be performed with even more stability.

The contents of Tokugan 2003-193455, with a filing date of Jul. 8, 2003 in Japan, are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

For example, in each of the embodiments described above, the warm-up operation of the internal combustion engine 1 is performed using intake stroke fuel injection. However, this invention, which relates to fuel injection during start-up, is applicable irrespective of fuel injection control during the warm-up operation.

For example, this invention is applicable to an internal combustion engine which performs the warm-up operation by means of stratified combustion using compression stroke fuel injection.

Furthermore, this invention is applicable to an internal combustion engine which switches from stratified combustion by means of compression stroke fuel injection to homogeneous combustion by means of intake stroke fuel injection in accordance with rises in the cooling water temperature Tw during the warm-up operation.

The embodiments of this invention in which an exclusive property or privilege is claimed are defined as follows:

What is claimed is:

1. A start-up control device of an internal combustion engine which operates on a four-stroke cycle constituted by an intake stroke, a compression stroke, an expansion stroke, and an exhaust stroke, the engine comprising a combustion chamber, a fuel injector which injects fuel directly into the combustion chamber, and a spark plug which ignites an air-fuel mixture inside the combustion chamber, the engine performing a start-up operation by cranking by a starter motor and performing a warm-up operation following the start-up operation, the control device comprising:

a sensor which detects an engine rotation speed; and a programmable controller programmed to:

set a stratified combustion start-up period;

control the fuel injector to inject fuel in the compression stroke from the beginning of the cranking to the end of the stratified combustion start-up period;

determine whether or not the engine rotation speed is greater than a predetermined rotation speed;

control the fuel injector to stop injecting fuel in the compression stroke in order to cause the engine to shift from the start-up operation to the warm-up operation when the engine rotation speed exceeds the predetermined rotation speed during the stratified combustion start-up period; and control the fuel injector to stop injecting fuel in the compression stroke at the end of the stratified combustion start-up period and to inject fuel in the intake stroke in order to cause the engine to continue the start-up operation when the engine rotation speed does not exceed the predetermined rotation speed during the stratified combustion start-up period.

2. The start-up control device as defined in claim 1, wherein the stratified combustion start-up period is defined by an amount of time elapsed from the beginning of the cranking.

3. The start-up control device as defined in claim 1, wherein the start-up control device comprises a counter which counts an accumulated number of rotations from the beginning of the cranking of the internal combustion engine, and the stratified combustion start-up period is defined by the accumulated number of rotations.

4. The start-up control device as defined in claim 1, wherein the start-up control device further comprises a sensor which detects a temperature of the internal combustion engine, and the controller is further programmed to increase the stratified combustion start-up period as the temperature of the internal combustion engine decreases.

5. The start-up control device as defined in claim 1, wherein the controller is further programmed to increase the stratified combustion start-up period as the rotation speed of the internal combustion engine during cranking decreases.

6. The start-up control device as defined in claim 1, wherein the start-up control device further comprises a sensor which detects a supply pressure of fuel to the fuel injector, and the controller is further programmed to increase the stratified combustion start-up period as the fuel supply pressure decreases.

7. The start-up control device as defined in claim 1, wherein the starter motor is operated by electric power supplied from a battery, the start-up control device further comprises a sensor which detects a supply voltage of the battery, and the controller is further programmed to increase the stratified combustion start-up period as the supply voltage of the battery decreases.

8. The start-up control device as defined in claim 1, wherein the controller is further programmed to control the fuel injector to stop fuel injection for the start-up operation and start fuel injection for the warm-up operation when the rotation speed of the engine exceeds the predetermined rotation speed after the end of the stratified combustion start-up period.

9. The start-up control device as defined in claim 1, wherein the controller is further programmed to control the fuel injector to perform fuel injection in the intake stroke during the warm-up operation.

10. A start-up control device of an internal combustion engine which operates on a four-stroke cycle constituted by an intake stroke, a compression stroke, an expansion stroke, and an exhaust stroke, the engine comprising a combustion chamber, a fuel injector which injects fuel directly into the combustion chamber, and a spark plug which ignites an air-fuel mixture inside the combustion chamber, the engine performing a start-up operation by cranking by a starter motor and performing a warm-up operation following the start-up operation, the control device comprising:

means for determining an engine rotation speed;

means for setting a stratified combustion start-up period;

means for controlling the fuel injector to inject fuel in the compression stroke from the beginning of the cranking to the end of the stratified combustion start-up period;

means for determining whether or not the engine rotation speed is greater than a predetermined rotation speed;

means for controlling the fuel injector to stop injecting fuel in the compression stroke in order to cause the engine to shift from the start-up operation to the warm-up operation when the engine rotation speed exceeds the predetermined rotation speed during the stratified combustion start-up period; and means for controlling the fuel injector to stop injecting fuel in the compression stroke at the end of the stratified combustion start-up period and to inject fuel in the intake stroke in order to cause the engine to continue the start-up operation when the engine rotation speed does not exceed the predetermined rotation speed during the stratified combustion start-up period.

11. A start-up control method of an internal combustion engine which operates on a four-stroke cycle constituted by an intake stroke, a compression stroke, an expansion stroke, and an exhaust stroke, the engine comprising a combustion chamber, a fuel injector which injects fuel directly into the combustion chamber, and a spark plug which ignites an air-fuel mixture inside the combustion chamber, the engine performing a start-up operation by cranking by a starter motor and performing a warm-up operation following the start-up operation, the control method comprising:

determining an engine rotation speed;

setting a stratified combustion start-up period;

controlling the fuel injector to inject fuel in the compression stroke from the beginning of the cranking to the end of the stratified combustion start-up period;

determining whether or not the engine rotation speed is greater than a predetermined rotation speed;

controlling the fuel injector to stop injecting fuel in the compression stroke in order to cause the engine to shift from the start-up operation to the warm-up operation when the engine rotation speed exceeds the predetermined rotation speed during the stratified combustion start-up period; and controlling the fuel injector to stop injecting fuel in the compression stroke at the end of the stratified combustion start-up period and to inject fuel in the intake stroke in order to cause the engine to continue the start-up operation when the engine rotation speed does not exceed the predetermined rotation speed during the stratified combustion start-up period.

* * * * *